US010926944B2

(12) United States Patent
Huang

(10) Patent No.: US 10,926,944 B2
(45) Date of Patent: Feb. 23, 2021

(54) CONTACT LENS PACKAGE AND CONTACT LENS PACKAGING METHOD

(71) Applicant: LARGAN MEDICAL CO., LTD., Taichung (TW)

(72) Inventor: Chen-Yi Huang, Taichung (TW)

(73) Assignee: LARGAN MEDICAL CO., LTD., Taichung (TW)

( * ) Notice: Subject to any disclaimer, the term of this patent is extended or adjusted under 35 U.S.C. 154(b) by 43 days.

(21) Appl. No.: 15/869,339

(22) Filed: Jan. 12, 2018

(65) Prior Publication Data

US 2019/0009977 A1 Jan. 10, 2019

(30) Foreign Application Priority Data

Jul. 7, 2017 (TW) ..... 10621005.4

(51) Int. Cl.

| | |
|---|---|
| ***B65D 85/00*** | (2006.01) |
| ***B65B 25/00*** | (2006.01) |
| ***B65B 11/48*** | (2006.01) |
| ***B65D 75/30*** | (2006.01) |
| ***B65D 75/20*** | (2006.01) |
| ***B65B 11/50*** | (2006.01) |
| *B65D 81/22* | (2006.01) |

(52) U.S. Cl.

CPC ..... *B65D 85/54* (2013.01); *B65B 11/48* (2013.01); *B65B 11/50* (2013.01); *B65B 25/008* (2013.01); *B65D 75/20* (2013.01); *B65D 75/30* (2013.01); *B65D 81/22* (2013.01); *B65D 2585/545* (2013.01)

(58) Field of Classification Search

CPC ..... A45C 11/005; A45C 11/046; A45C 11/04; B65D 85/54; B65D 2585/545

USPC ..... 206/5.1, 205

See application file for complete search history.

(56) References Cited

U.S. PATENT DOCUMENTS

| | | | | |
|---|---|---|---|---|
| 5,598,601 | A * | 2/1997 | Eaton | A47L 25/00 15/214 |
| 7,086,526 | B2 | 8/2006 | Newman | |
| 7,461,740 | B2 * | 12/2008 | Newman | A45C 11/005 206/5.1 |
| 7,850,002 | B2 | 12/2010 | Newman | |
| 7,938,255 | B2 * | 5/2011 | Newman | A45C 11/005 206/5.1 |
| 7,967,133 | B2 * | 6/2011 | Newman | A45C 11/005 206/5.1 |
| 8,104,608 | B2 * | 1/2012 | Newman | A45C 11/005 206/5.1 |

(Continued)

FOREIGN PATENT DOCUMENTS

| | | |
|---|---|---|
| TW | I459938 B | 11/2014 |
| TW | I488616 B | 6/2015 |

(Continued)

*Primary Examiner* — Steven A. Reynolds

(74) *Attorney, Agent, or Firm* — McClure, Qualey & Rodack, LLP

(57) ABSTRACT

The present disclosure proposes a contact lens package. The contact lens package includes a first substrate, a contact lens, and a guard ring. The contact lens is disposed on the first substrate. The guard ring is disposed on the first substrate and surrounds the contact lens, wherein the guard ring is fixed on a side surface of the first substrate. The contact lens and the guard ring are surrounded and sealed in the first substrate.

15 Claims, 16 Drawing Sheets

(56) References Cited

U.S. PATENT DOCUMENTS

| | | | | |
|---|---|---|---|---|
| 8,763,794 | B2 | 7/2014 | Newman | |
| 8,955,672 | B2 | 2/2015 | Newman | |
| 9,615,639 | B2 * | 4/2017 | Newman | A45C 11/005 |
| 2006/0011496 | A1 * | 1/2006 | Mangabeira Nunez | A45C 11/005 206/5.1 |
| 2008/0078681 | A1 * | 4/2008 | Newman | A45C 11/005 206/5.1 |
| 2009/0200182 | A1 * | 8/2009 | Post-Smith | A45C 11/005 206/5.1 |
| 2015/0122671 | A1 * | 5/2015 | Newman | A45C 11/005 206/205 |

FOREIGN PATENT DOCUMENTS

| | | | |
|---|---|---|---|
| TW | I513427 | B | 12/2015 |
| TW | I571253 | B | 2/2017 |

* cited by examiner

CONTACT LENS PACKAGE AND CONTACT LENS PACKAGING METHOD

RELATED APPLICATIONS

This application claims priority to Taiwan Application Serial Number 106210054, filed Jul. 7, 2017, which is herein incorporated by reference.

BACKGROUND

Technical Field

The present disclosure relates to a contact lens package and a contact lens packaging method. More particularly, the present disclosure relates to a contact lens package disposed with a guard ring and a contact lens packaging method thereof.

Description of Related Art

Conventionally, package of disposable contact lenses mainly includes a plastic body and a flexible cover. The plastic body usually has a circular recess for containing a single contact lens and enough buffer liquid or contact lens solution, while the flexible cover being used to seal the circular recess for preserving the contact lens therein. Moreover, a part of the flexible cover will not be sealed with the plastic body for the user to hold and rip the flexible cover off the plastic body, such that the contact lens in the circular recess can be retrieved.

However, since the circular recess makes the package thicker, the volume of the package cannot be reduced. Moreover, the flexible cover is usually tightly sealed with the plastic body for preventing the contact lens solution from leaking. In this case, the user may rip the flexible cover with too much force, such that the contact lens and the contact lens solution may be accidentally tossed and spilled out of the package.

Further, there exists another conventional package which seals the contact lens and the buffer liquid merely with two aluminum foils. However, this aforementioned package is fragile and more likely to be damaged during transportation.

SUMMARY

According to one aspect of the present disclosure, a contact lens package including a first substrate, a contact lens, and a guard ring. The contact lens is disposed on the first substrate. The guard ring is disposed on the first substrate and surrounds the contact lens, wherein the guard ring is fixed on a side surface of the first substrate. The contact lens and the guard ring are surrounded and sealed in the first substrate.

According to one aspect of the present disclosure, a contact lens package including a first substrate, a contact lens, and a guard ring. The contact lens is disposed on a first surface of the first substrate. The guard ring is fixed on a second surface of the first substrate, and a projection of the guard ring on the first surface surrounds the contact lens. The contact lens is sealed in the first substrate.

According to one aspect of the present disclosure, a contact lens packaging method, applicable to a contact lens package array, wherein the contact lens package array includes a plurality of contact lenses, a plurality of guard rings, and a plurality of first substrates. The method includes the following steps: disposing each of the guard rings onto a first surface of each of the first substrates; placing each of the contact lenses into each of the guard rings; folding the first substrates; and hot-press sealing the contact lens package array.

BRIEF DESCRIPTION OF THE DRAWINGS

The present disclosure can be more fully understood by reading the following detailed description of the embodiment, with reference made to the accompanying drawings as follows.

DETAILED DESCRIPTION

1st Embodiment

Figure 1A:
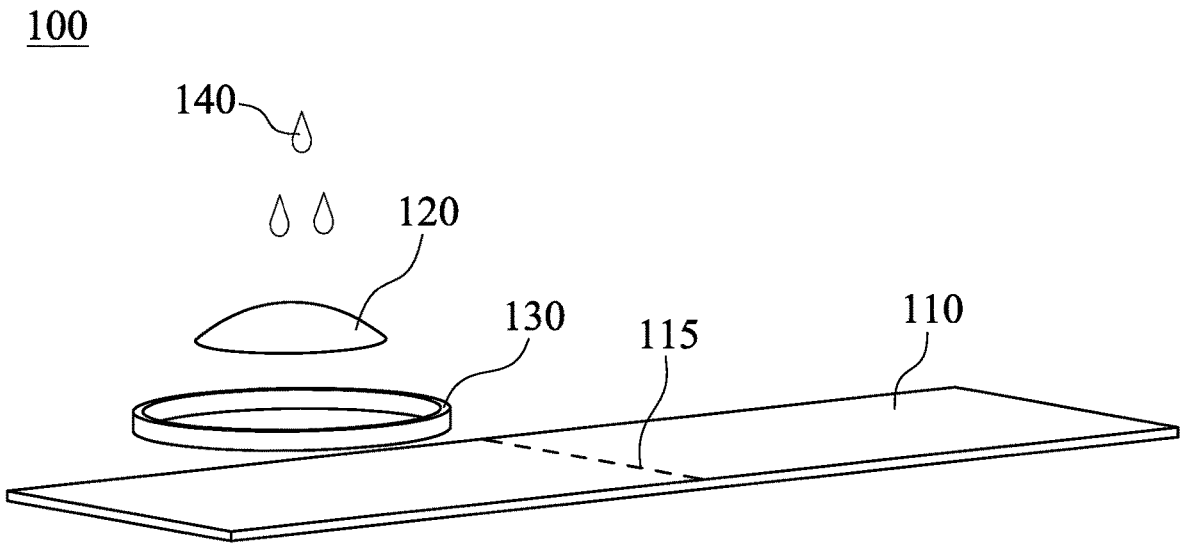
FIG. 1A is an exploded view of a contact lens package of the 1st embodiment of the present disclosure.
Figure 1B:
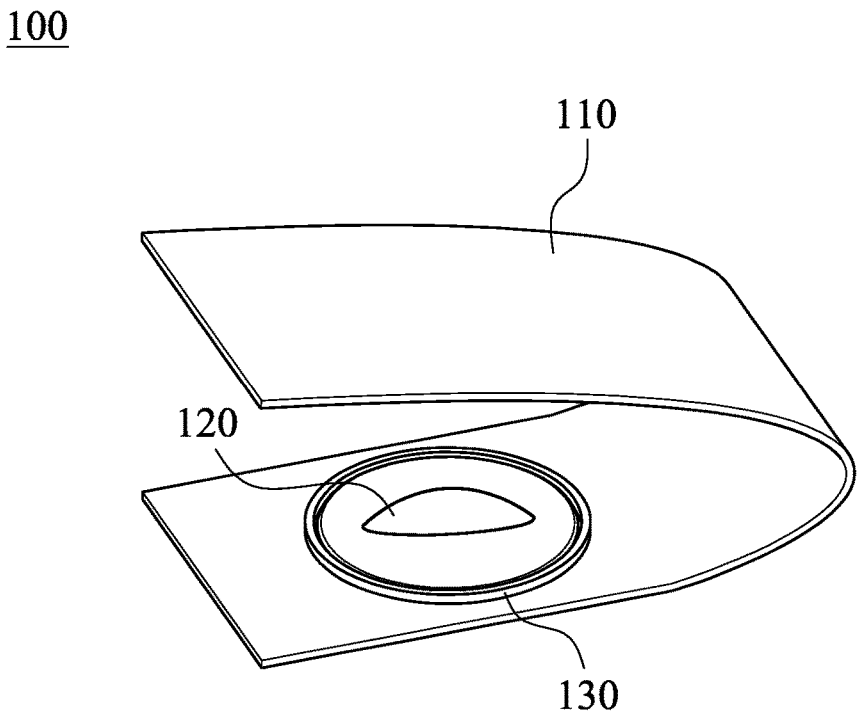
FIG. 1B is a schematic view of folding a first substrate of FIG. 1A.

See FIG. 1A and FIG. 1B, wherein FIG. 1A is an exploded view of a contact lens package 100 of the 1st embodiment of the present disclosure, and FIG. 1B is a schematic view of folding a first substrate 110 of FIG. 1A. In FIG. 1A and FIG. 1B, the contact lens package 100 includes a first substrate 110, a contact lens 120, and a guard ring 130. The contact lens 120 is disposed on the first substrate 110. The guard ring 130 is disposed on the first substrate 110 and surrounds the contact lens 120, wherein the guard ring 130 is fixed on a side surface of the first substrate 110 (by using adhesives). The contact lens 120 and the guard ring 130 are surrounded and sealed in the first substrate 110. In one embodiment, the first substrate 110 may be an aluminum foil, but the present disclosure is not limited thereto.

In the 1st embodiment, the first substrate 110 may be disposed with a folding line 115, and the contact lens 120 and the guard ring 130 may be disposed at an end away from the folding line 115. Accordingly, the first substrate 110 may be folded along the folding line 115, and the region outside of the guard ring 130 can be bonded to seal the contact lens 120 and the guard ring 130 inside the first substrate 110.

In the 1st embodiment, when a height of the guard ring 130 is Tr, the following condition can be satisfied: 1.5 mm<Tr<3.5 mm. Specifically, in the 1st embodiment, Tr is 2 mm. Thus, the guard ring 130 can provide better protection for the contact lens package 100 without adding too much thickness.

Figure 2A:
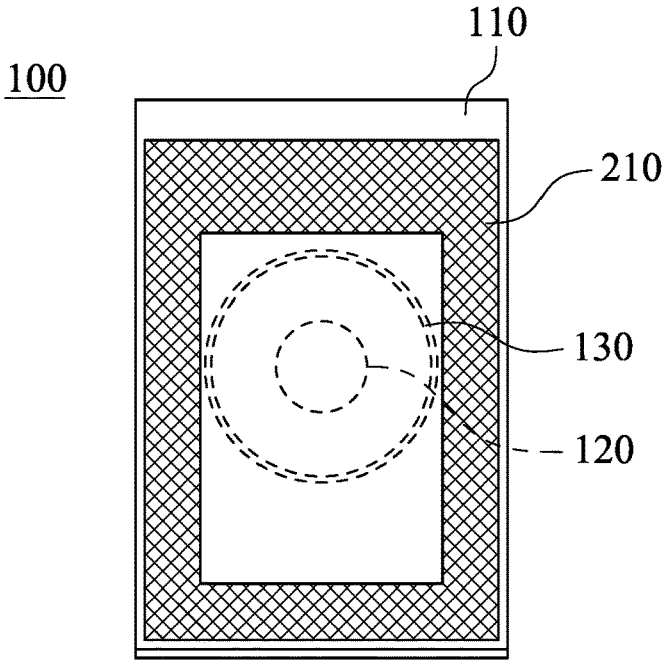
FIG. 2A is a schematic view of the sealed contact lens package of the 1st embodiment of the present disclosure.

See FIG. 2A, which is a schematic view of the sealed contact lens package 100 of the 1st embodiment of the present disclosure. In FIG. 2A, a shaded area 210 is, for example, the region bonded after the first substrate 110 is folded, but the present disclosure is not limited thereto. The guard ring 130 slightly increases the thickness of the contact lens package 100 after the first substrate 110 is sealed. In other words, the overall volume of the contact lens package of the present disclosure may be reduced while mitigating the possibility of damaging the contact lens package, such that the contact lens 120 may be better protected.

Figure 2B:
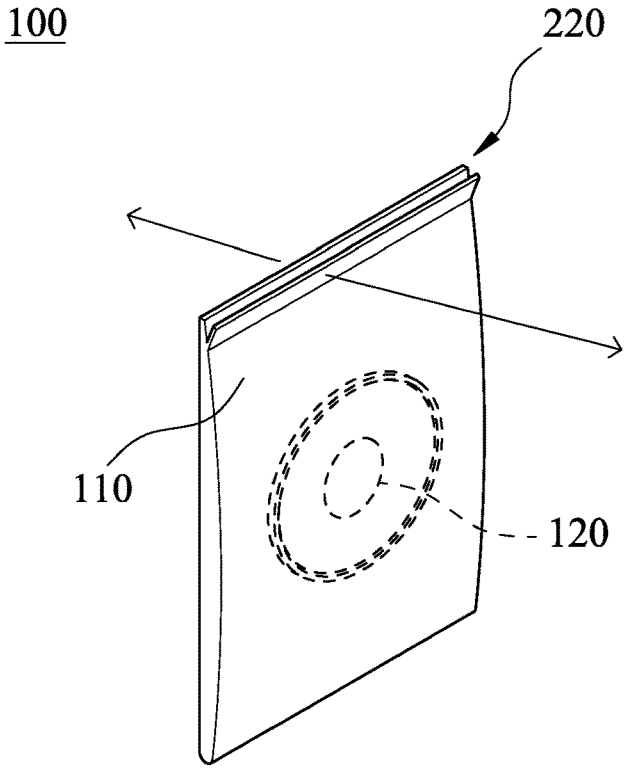
FIG. 2B is a 3-D view of the contact lens package of FIG. 2A.

See FIG. 2B, which is a 3-D view of the contact lens package 100 of FIG. 2A. In FIG. 2B, two ends of the first substrate 110 may be left with regions that are not bonded to form a holding portion 220 for allowing the user to hold. As such, the user may pinch the holding portion 220 and tear the first substrate 110 apart along the direction of the illustrated arrow to retrieve the contact lens 120. Accordingly, it becomes easier to retrieve the contact lens 120 for the user.

In addition, the contact lens package 100 may further include a buffer liquid 140 (shown in FIG. 1A) which is disposed on the first substrate 110 and contacted the contact lens 120. Accordingly, the storage life of the contact lens 120 may be prolonged.

2nd Embodiment

Figure 3A:
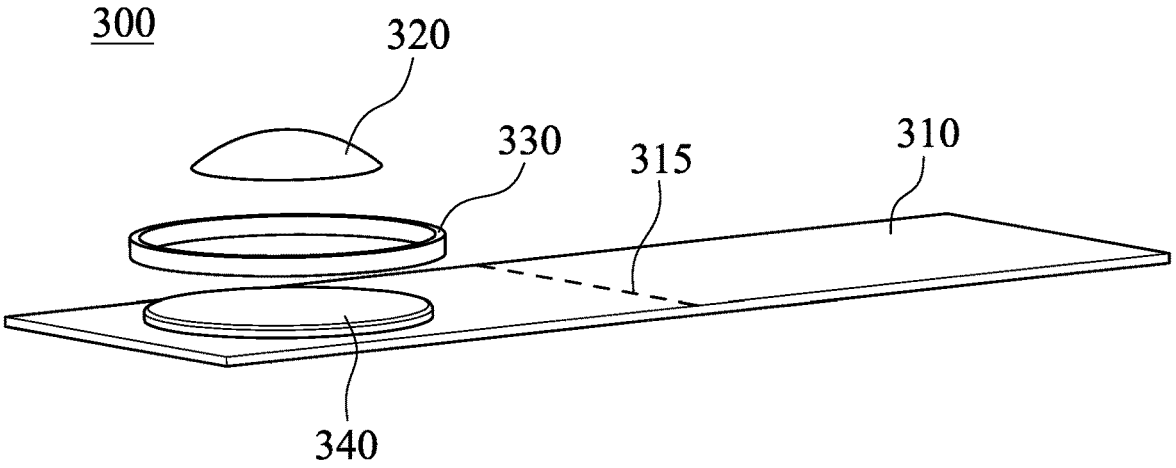
FIG. 3A is an exploded view of a contact lens package of the 2nd embodiment of the present disclosure.
Figure 3B:
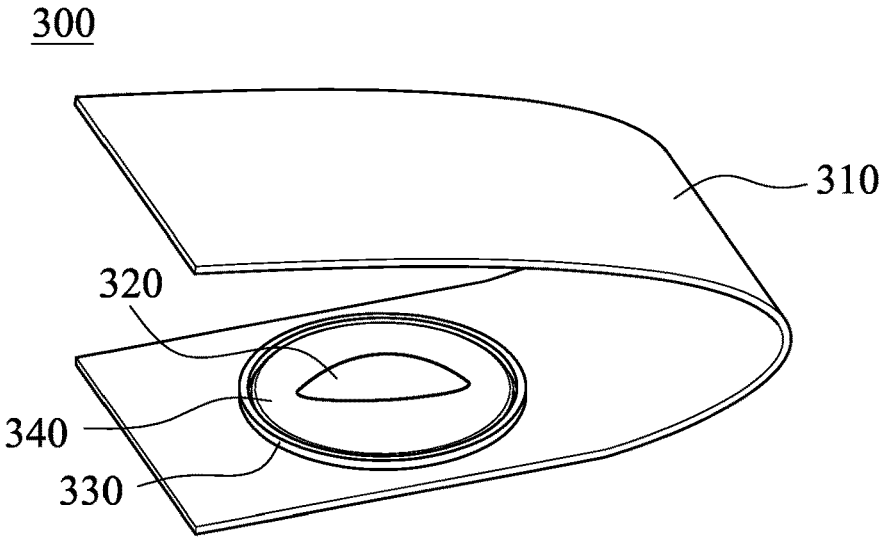
FIG. 3B is a schematic view of folding a first substrate of FIG. 3A.
Figure 3C:
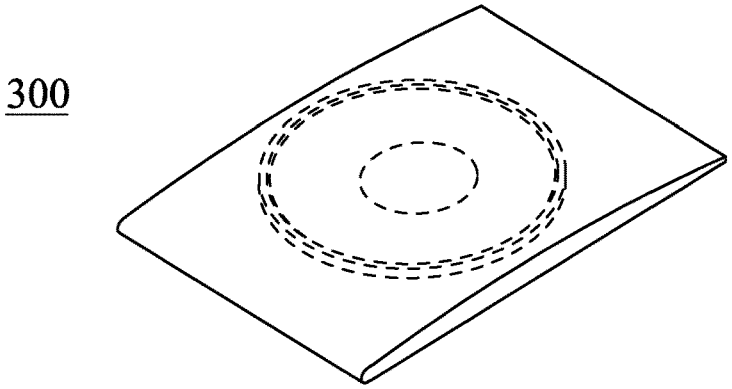
FIG. 3C is a schematic view of the sealed contact lens package of FIG. 3B.

See FIG. 3A, FIG. 3B, and FIG. 3C, wherein FIG. 3A is an exploded view of a contact lens package 300 of the 2nd embodiment of the present disclosure, FIG. 3B is a schematic view of folding a first substrate 310 of FIG. 3A, and FIG. 3C is a schematic view of the sealed contact lens package 300 of FIG. 3B. In FIG. 3A, FIG. 3B, and FIG. 3C, the contact lens package 300 includes the first substrate 310, a contact lens 320, a guard ring 330, and a carrier 340. The contact lens 320 is disposed above the first substrate 310. The guard ring 330 is disposed on the first substrate 310 and surrounds the contact lens 320, wherein the guard ring 330 is fixed on a side surface of the first substrate 310 by adhesives. The carrier 340 is disposed between the contact lens 320 and the first substrate 310 and surrounded by the guard ring 330. The contact lens 320 and the guard ring 330 are surrounded and sealed in the first substrate 310. Accordingly, the contact lens 320 may be prevented from an overly strong attachment of the first substrate 310 during user retrieval, and hence the contact lens 320 can be retrieved more easily. The carrier 340 may be manufactured by ways of injection molding, adhesion or scraping, but the present disclosure is not limited thereto.

In the 2nd embodiment, the first substrate 310 may be disposed with a folding line 315, and the contact lens 320 and the guard ring 330 may be disposed at an end away from the folding line 315. A peripheral region of the carrier 340 may be fixed to the first substrate 310. Therefore, the first substrate 310 may be folded along the folding line 315, and the region outside of the guard ring 330 can be bonded to seal the contact lens 320, the carrier 340, and the guard ring 330 inside the first substrate 310, as shown in FIG. 3C.

In the 2nd embodiment, when a thickness of the carrier 340 is Ts, and a height of the guard ring 330 is Tr, the following condition can be satisfied: 1.5<Tr/Ts<7. Accordingly, the contact lens 320 may be prevented from being overly squeezed by the first substrate 310 after the first substrate 310 is sealed. Specifically, in the 2nd embodiment, Tr=2 mm, Ts=1 mm, and Tr/Ts=2. Preferably, Tr may satisfy the following condition: 1.5 mm<Tr<3.5 mm.

In the 2nd embodiment, when the thickness of the carrier 340 is Ts, the following condition can be satisfied: 0.5 mm<Ts<2 mm. Accordingly, the overall size of the contact lens package 300 may be better configured. Preferably, the following condition can be satisfied: 0.5 mm<Ts<1 mm.

In the 2nd embodiment, when a diameter of the carrier 340 is Ds and an inner diameter of the guard ring 330 is Dr, the following condition can be satisfied: 0.6<Ds/Dr<1.6. Accordingly, the size proportion between the carrier 340 and the guard ring 330 may be better configured to improve the yield. Specifically, in the 2nd embodiment, Ds=21.5 mm, Dr=20 mm, and Ds/Dr=1.075.

In one embodiment, the contact lens package 300 may further include a buffer liquid (not shown) which is disposed on the first substrate 310 and contacted the contact lens 320. When a volume of the buffer liquid is Vb, the thickness of the carrier 340 is Ts, and the height of the guard ring 330 is Tr, the following condition can be satisfied: 0.16<Vb/(Tr−Ts)<20. Accordingly, the space configuration of the contact lens 320 and the buffer liquid can be better controlled while reducing the complexity of manufacturing the contact lens package 300, such that the size of the contact lens package 300 can be better configured. Preferably, the following condition can be satisfied: 0.3<Vb/(Tr−Ts)<5.

3rd Embodiment

Figure 4A:
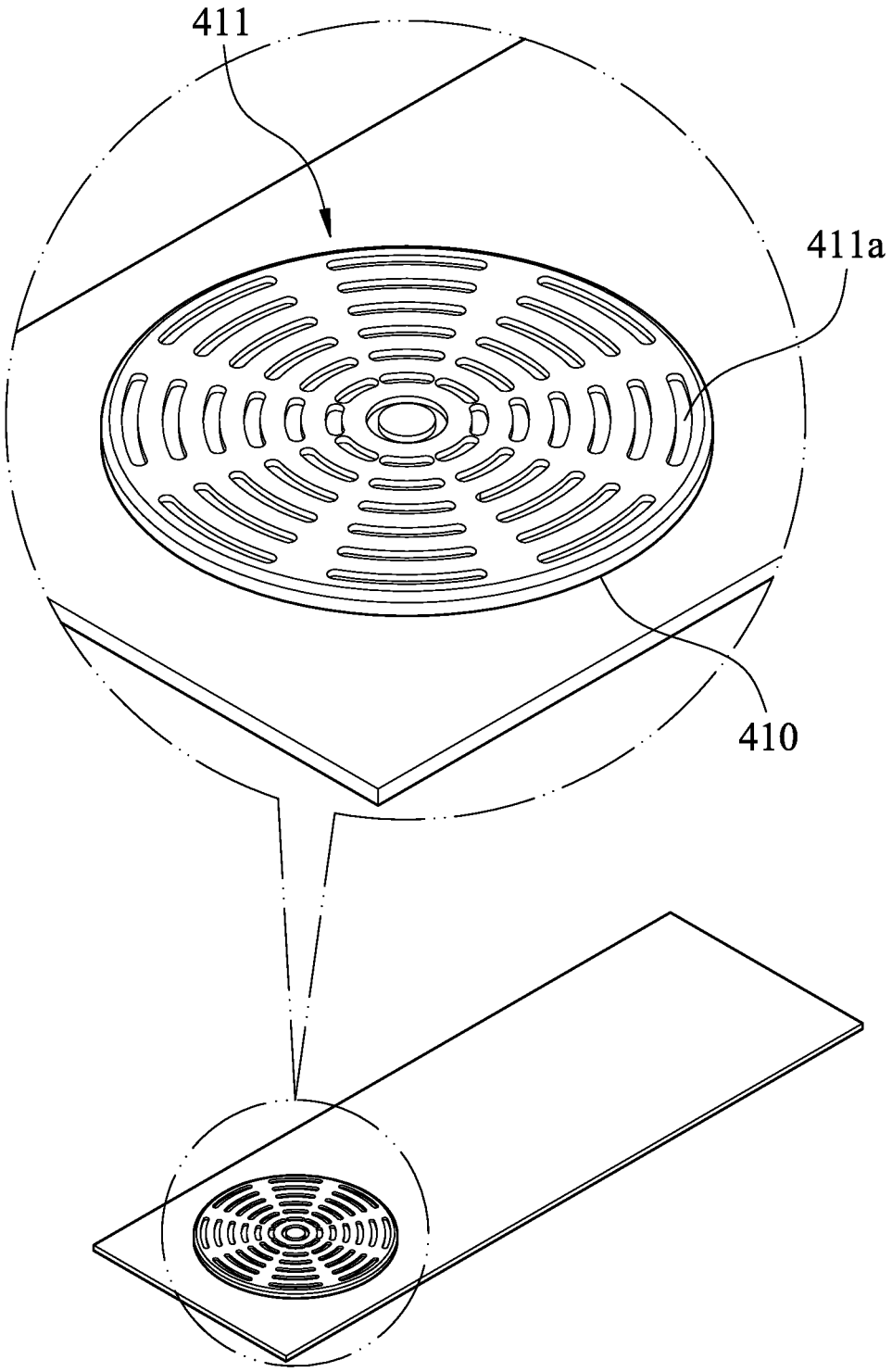
FIG. 4A is a schematic view of a texture structure of the 3rd embodiment of the present disclosure.
Figure 4B:
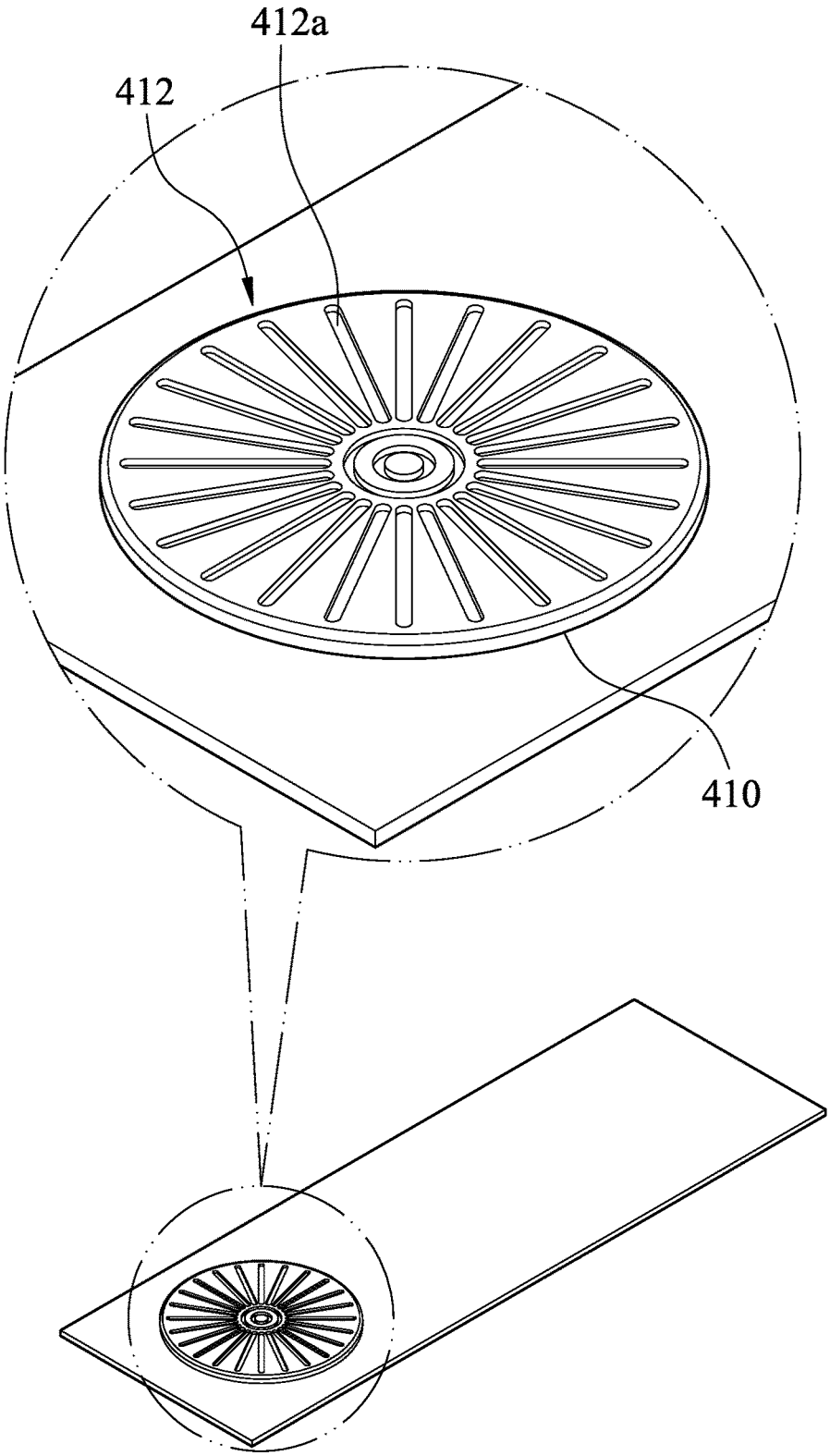
FIG. 4B is a schematic view of another texture structure of the 3rd embodiment of the present disclosure.

See FIG. 4A and FIG. 4B, wherein FIG. 4A is a schematic view of a texture structure 411 of the 3rd embodiment of the present disclosure, and FIG. 4B is a schematic view of another texture structure 412 of the 3rd embodiment of the present disclosure. In the 3rd embodiment, the carrier 410 may be disposed with a texture structure. Specifically, in FIG. 4A, the texture structure 411 includes a plurality of holes 411*a* which are arranged radially from a center of the carrier 410. Additionally, in FIG. 4B, the texture structure 412 includes a plurality of holes 412*a*, and each of the holes 412*a* is elongated and arranged radially from the center of the carrier 410. Accordingly, when the contact lens (not shown) is placed on the carrier 410, the contact lens will not be completely fitted to the carrier 410, such that it may be easier for retrieving the contact lens from the carrier 410 for the user.

Figure 5A:
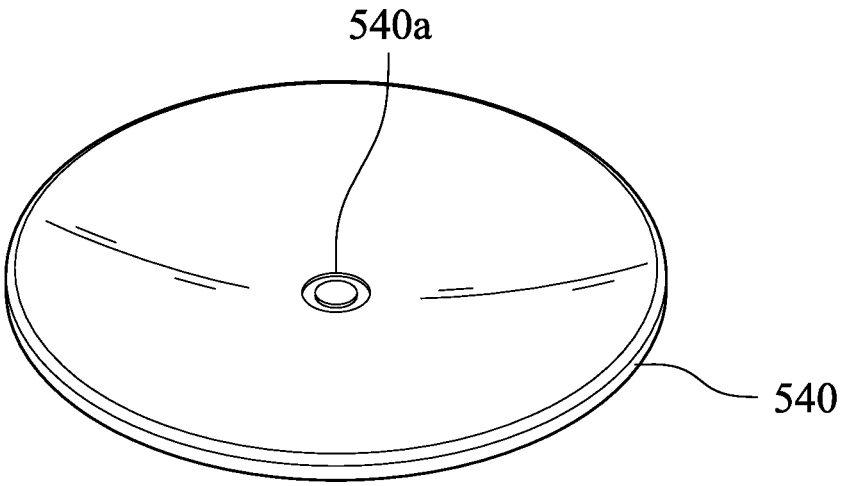
FIG. 5A is a schematic view of a carrier of the 3rd embodiment of the present disclosure.

See FIG. 5A, which is a schematic view of a carrier 540 of the 3rd embodiment of the present disclosure. In FIG. 5A, the carrier 540 may be a circular plate with a central recess, but the present disclosure is not limited thereto. Accordingly, the carrier 540 may be more compatible with the contact lens (not shown) which is arc-shaped, and hence the possibility of deforming the contact lens can be mitigated. Moreover, a flexible structure 540*a* is disposed at a center of the carrier 540. Accordingly, the user may separate the contact lens from the carrier 540 by pushing from the bottom of the carrier 540 upward, such that the contact lens may be retrieved.

Figure 5B:
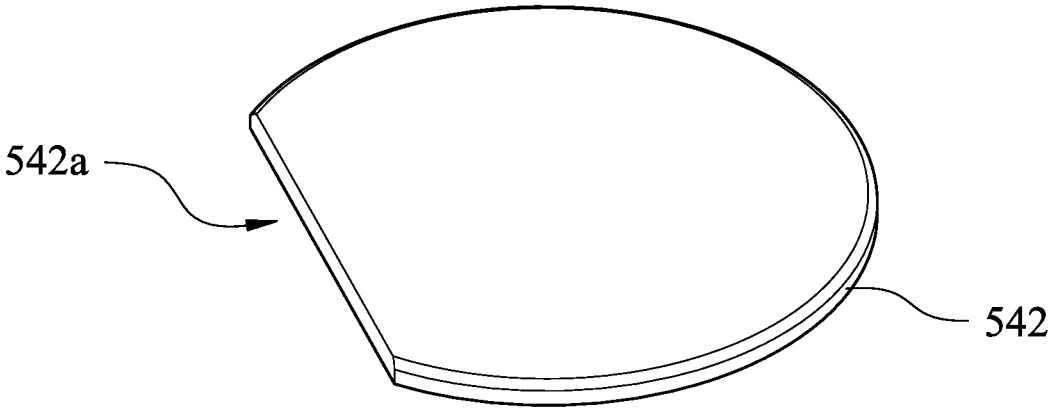
FIG. 5B is a schematic view of another carrier of the 3rd embodiment of the present disclosure.

See FIG. 5B, which is a schematic view of another carrier 542 of the 3rd embodiment of the present disclosure. In the 3rd embodiment, a notch 542*a* (e.g., a D-shaped notch) may be disposed on the carrier 542 for facilitating the user to separate the contact lens (not shown) from the carrier 542.

4th Embodiment

Figure 6:
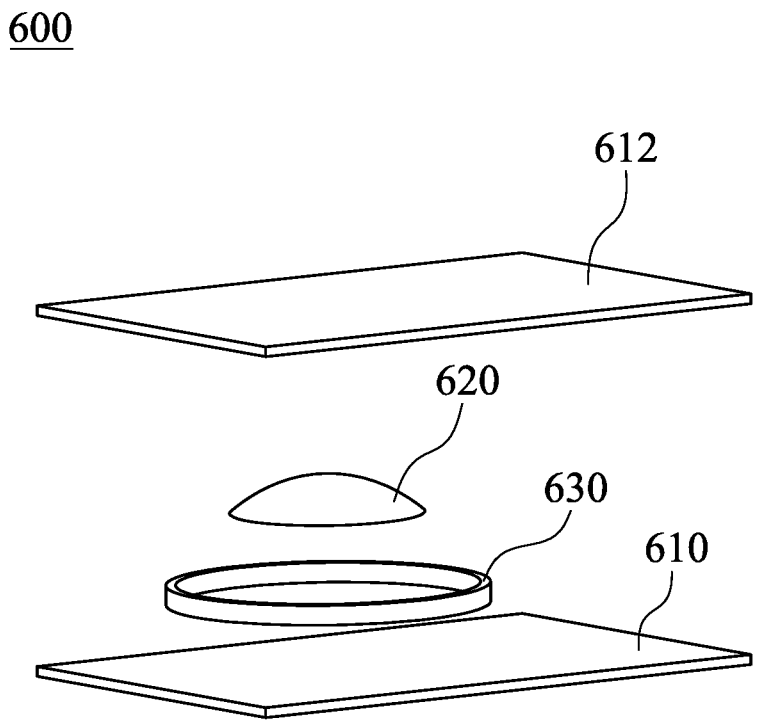
FIG. 6 is an exploded view of a contact lens package of the 4th embodiment of the present disclosure.

See FIG. 6, which is an exploded view of a contact lens package 600 of the 4th embodiment of the present disclosure. In FIG. 6, the contact lens package 600 includes a first substrate 610, a second substrate 612, a contact lens 620, and a guard ring 630. The contact lens 620 is disposed on the first substrate 610. The guard ring 630 is disposed on the first substrate 610 and surrounds the contact lens 620, wherein the guard ring 630 is fixed on a side surface of the first substrate 610. The first substrate 610 and the second substrate 612 may be bonded with each other to seal the contact lens 620 and the guard ring 630 between the first substrate 610 and the second substrate 612. Accordingly, the position configuration of the contact lens 620 and the guard ring 630 may be disposed more freely, and hence the degree of freedom of the manufacturing process may be increased.

In addition, the first substrate 610 and the second substrate 612 may be left with regions that are not bonded (e.g., the holding portion 220 of FIG. 2B) for facilitating the user to hold and tear the first substrate 610 and the second substrate 612 apart to retrieve the contact lens 620. In one embodiment, the second substrate 612 and the guard ring 630 may be integrally formed as a hard plastic cap, but the present disclosure is not limited thereto.

In the contact lens package 600, the carrier 340 shown in FIG. 3A, FIG. 3B, and FIG. 3B may be disposed between the contact lens 620 and the first substrate 610, but the present disclosure is not limited thereto.

5th Embodiment

Figure 7A:
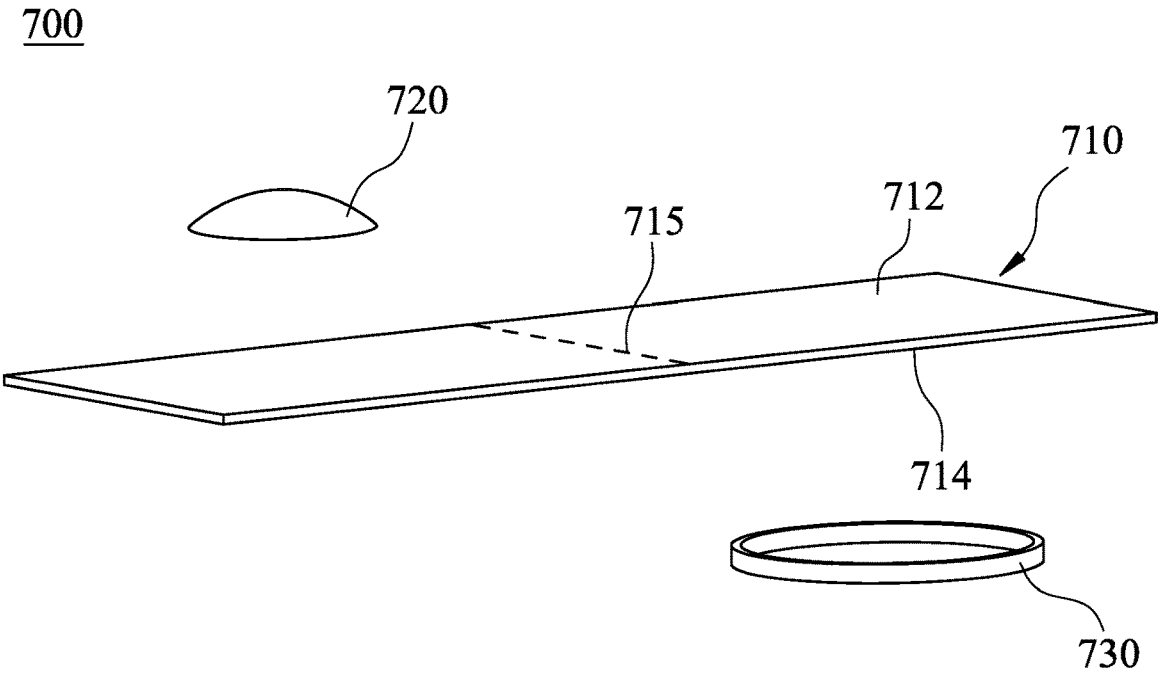
FIG. 7A is an exploded view of a contact lens package of the 5th embodiment of the present disclosure.
Figure 7B:
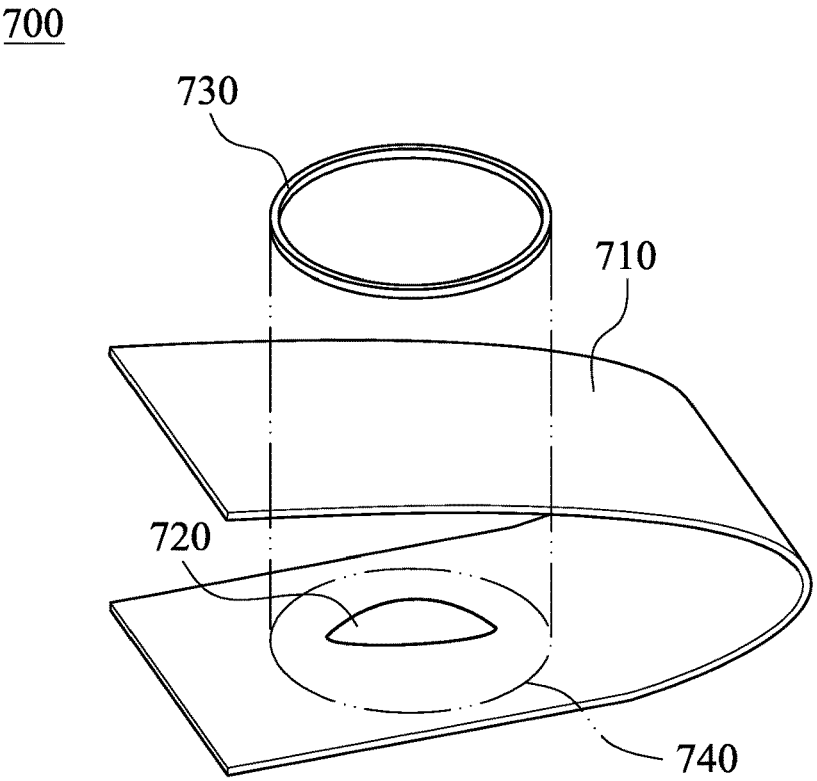
FIG. 7B is a schematic view of folding a first substrate of FIG. 7A.
Figure 7C:
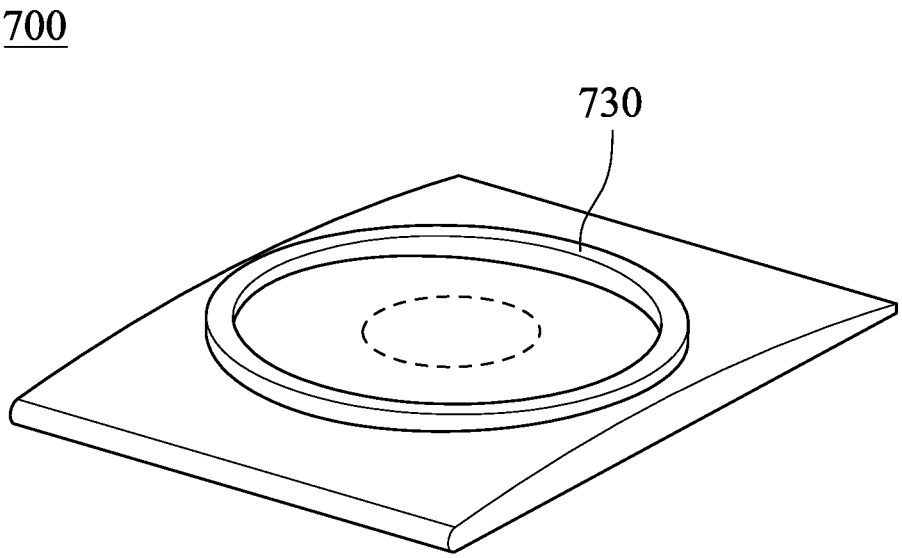
FIG. 7C is a schematic view of the sealed contact lens package of FIG. 7B.
Figure 7D:
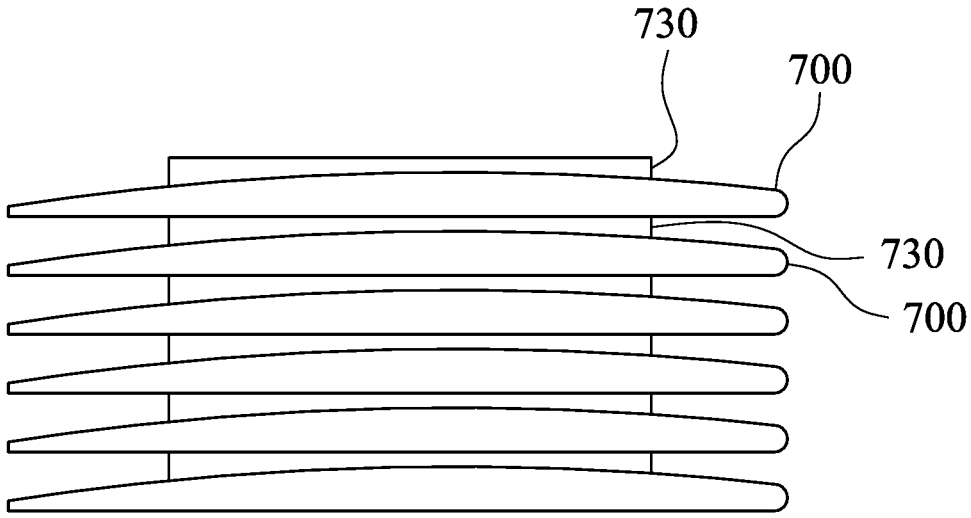
FIG. 7D is a schematic view of stacking a plurality of the contact lens packages of FIG. 7C.

See FIG. 7A, FIG. 7B, FIG. 7C, and FIG. 7D, wherein FIG. 7A is an exploded view of a contact lens package 700 of the 5th embodiment of the present disclosure, FIG. 7B is a schematic view of folding a first substrate 710 of FIG. 7A, FIG. 7C is a schematic view of the sealed contact lens package 700 of FIG. 7B, and FIG. 7D is a schematic view of stacking a plurality of the contact lens packages 700 of FIG. 7C. In FIG. 7A and FIG. 7B, the contact lens package 700 includes the first substrate 710, a contact lens 720, and a guard ring 730. The contact lens 720 is disposed on a first surface 712 of the first substrate 710. The guard ring 730 is fixed on a second surface 714 of the first substrate 710, and a projection 740 of the guard ring 730 on the first surface 712 surrounds the contact lens 720 when folded (as shown in FIG. 7B). The contact lens 720 is sealed in the first substrate 710.

In the 5th embodiment, the first substrate 710 may be disposed with a folding line 715, and the contact lens 720 may be disposed at an end away from the folding line 715. Accordingly, the first substrate 710 may be folded along the folding line 715, and the region outside of the contact lens 720 can be bonded to seal the contact lens 720 inside the first substrate 710, as shown in FIG. 7C. Accordingly, not only the contact lens 720 can be securely protected, but the plurality of the contact lens packages 700 may also allow stacking with each other without squeezing or damaging the contact lens 720, as shown in FIG. 7D.

In other embodiments, the contact lens package 700 may further include a buffer liquid (not shown) which may be disposed on the first substrate 710 and contacted the contact lens 720.

6th Embodiment

Figure 8A:
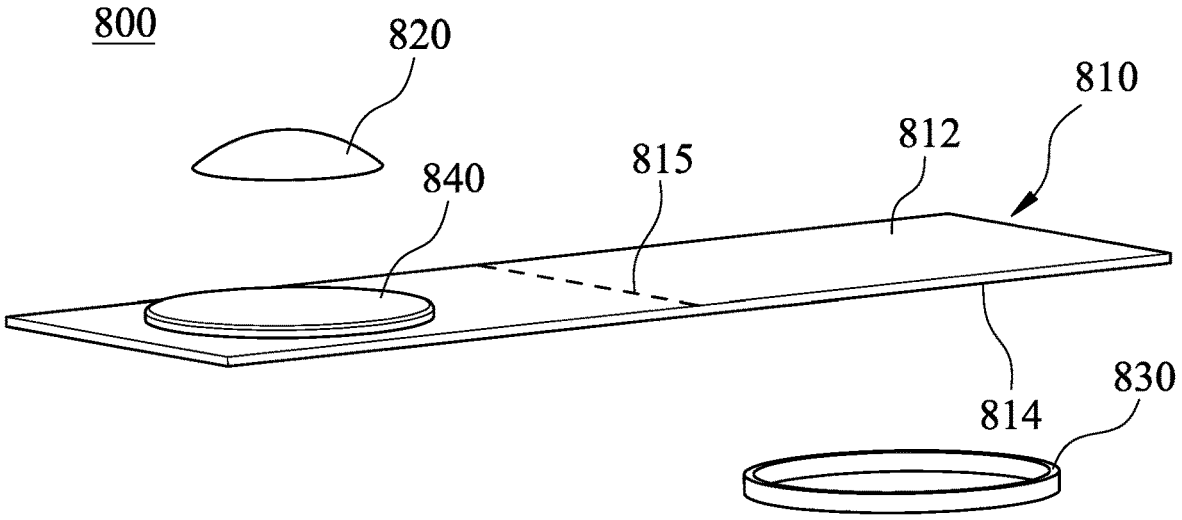
FIG. 8A is an exploded view of a contact lens package of the 6th embodiment of the present disclosure.
Figure 8B:
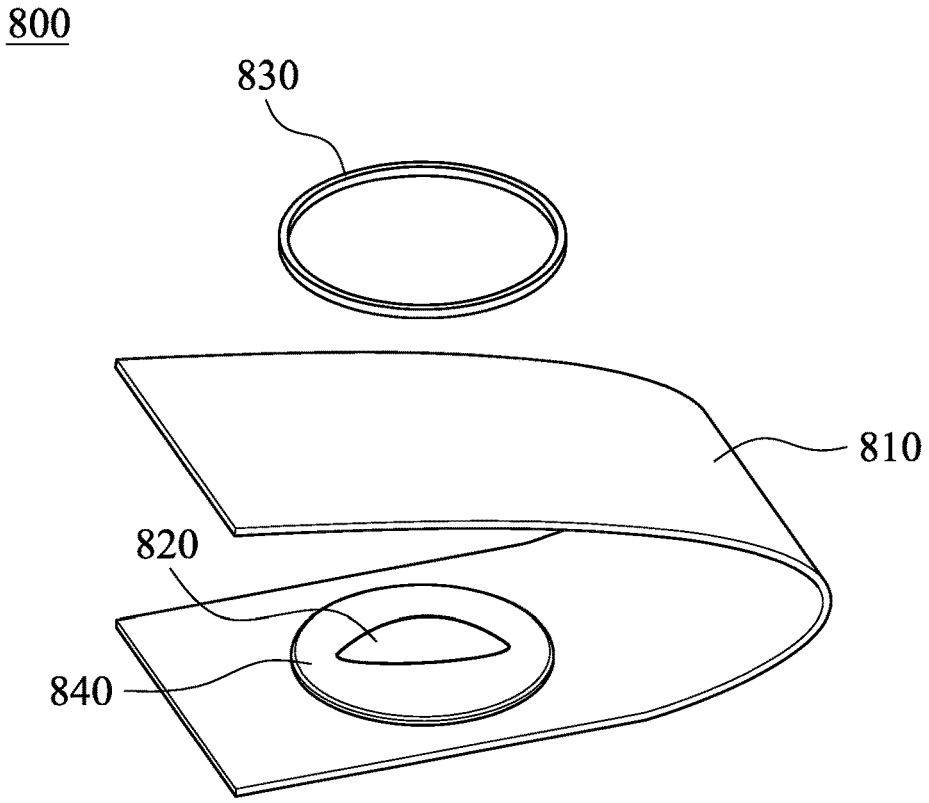
FIG. 8B is a schematic view of folding a first substrate of FIG. 8A.

See FIG. 8A and FIG. 8B, wherein FIG. 8A is an exploded view of a contact lens package 800 of the 6th embodiment of the present disclosure, and FIG. 8B is a schematic view of folding a first substrate 810 of FIG. 8A. In FIG. 8A and FIG. 8B, the contact lens package 800 includes the first substrate 810, a contact lens 820, a guard ring 830, and a carrier 840. The contact lens 820 is disposed on a first surface 812 of the first substrate 810. The guard ring 830 is fixed on a second surface 814 of the first substrate 810, and a projection (not shown) of the guard ring 830 on the first surface 812 surrounds the contact lens 820 when folded. The contact lens 820 is sealed in the first substrate 810. The carrier 840 is disposed between the contact lens 820 and the first substrate 810 and surrounded by the projection of the guard ring 830 on the first surface 812 when folded. The first substrate 810 seals and preserves the contact lens 820. Accordingly, the possibility of deforming the contact lens 820 can be reduced by preventing the contact lens 820 from completely fitting the first substrate 810.

In the 6th embodiment, the first substrate 810 may be disposed with a folding line 815, and the contact lens 820 may be disposed at an end away from the folding line 815. A peripheral region of the carrier 840 may be fixed to the first substrate 810. Therefore, the first substrate 810 may be folded along the folding line 815, and the region of the first substrate 810 outside of the contact lens 820 and the carrier 840 can be bonded to seal the contact lens 820 inside the first substrate 810.

The carrier 840 may be disposed with the texture structure 411 shown in FIG. 4A or the texture structure 412 shown in FIG. 4B. Alternatively, the carrier 840 may be configured as shown in FIG. 5A and FIG. 5B, but the present disclosure is not limited thereto.

7th Embodiment

Figure 9:
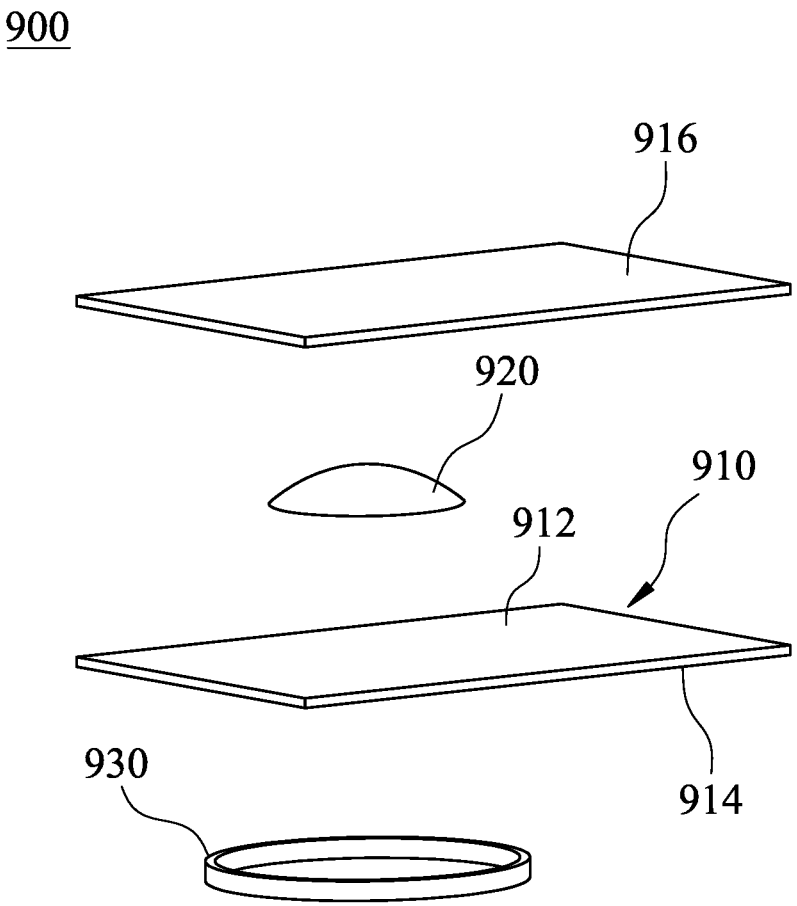
FIG. 9 is an exploded view of a contact lens package of the 7th embodiment of the present disclosure.

See FIG. 9, which is an exploded view of a contact lens package 900 of the 7th embodiment of the present disclosure. In FIG. 9, the contact lens package 900 includes a first substrate 910, a second substrate 916, a contact lens 920, and a guard ring 930. The contact lens 920 is disposed on a first surface 912 of the first substrate 910. The guard ring 930 is fixed on a second surface 914 of the first substrate 910, and a projection of the guard ring 930 on the first surface 912 surrounds the contact lens 920. The first substrate 910 and the second substrate 916 may be bonded with each other, such that the contact lens 920 can be sealed between the first substrate 910 and the second substrate 916. Accordingly, the position of the contact lens 920 may be disposed more freely, and hence the degree of freedom of the manufacturing process may be improved.

In addition, the first substrate 910 and the second substrate 916 may have regions away from the contact lens 920 that are not bonded (e.g., the holding portion 220 of FIG. 2B) for facilitating the user to hold and tear the first substrate 910 and the second substrate 916 apart to retrieve the contact lens 920.

The carrier 840 shown in FIG. 8A, FIG. 8B, and FIG. 8C may be disposed between the contact lens 920 and the first substrate 910, but the present disclosure is not limited thereto.

8th Embodiment

Figure 10:
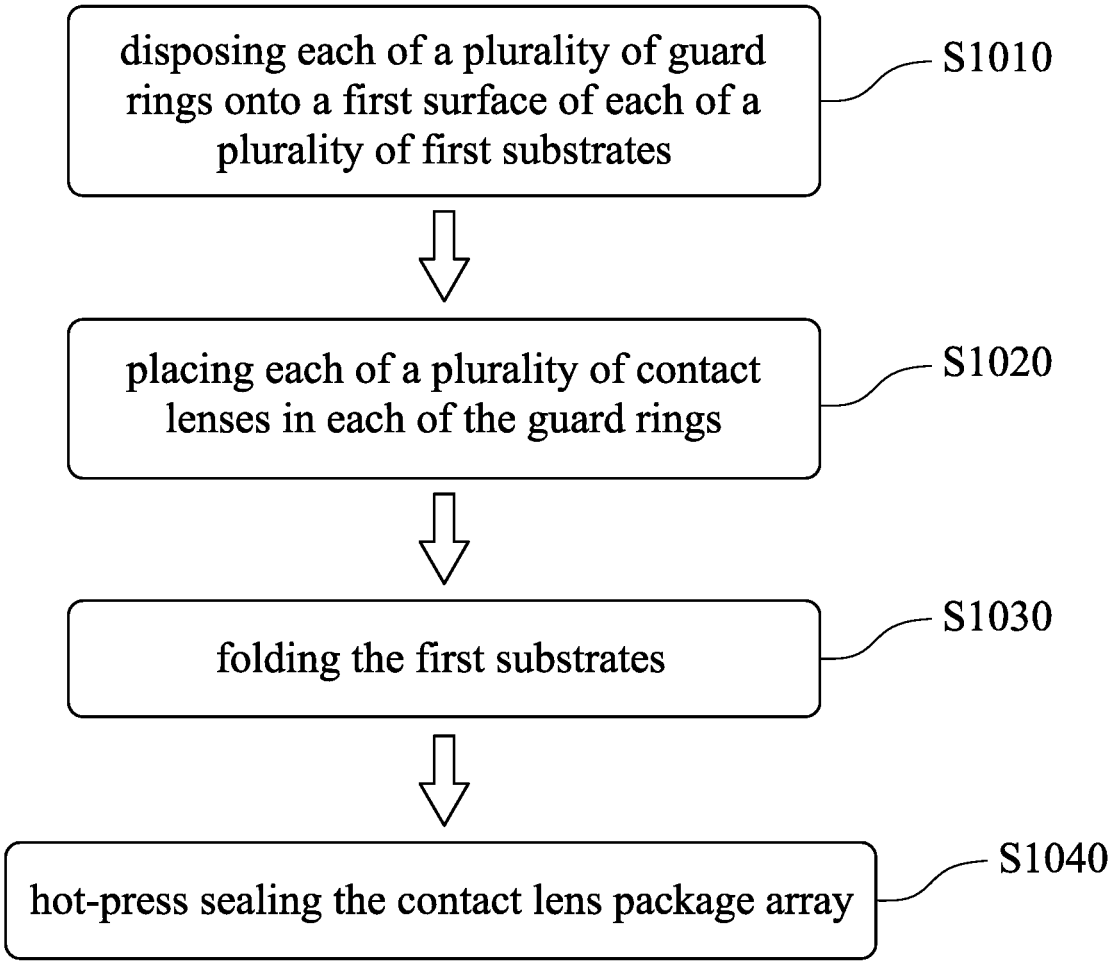
FIG. 10 is a flow chart of a contact lens packaging method of the 8th embodiment.

See FIG. 10, which is a flow chart of a contact lens packaging method of the 8th embodiment. The method of the 8th embodiment may be applicable to a contact lens package array, wherein the contact lens package array includes a plurality of contact lenses, a plurality of guard rings, and a plurality of first substrates. In step S1010, each of the guard rings is disposed onto a first surface of each of the first substrates; in step S1020, each of the contact lenses is placed into each of the guard rings; in step S1030, the first substrates are folded; and in step S1040, the contact lens package array is hot-press sealed.

Additionally, the carriers may be disposed onto the first surface of each of the first substrates before step S1010. Furthermore, a buffer liquid may be disposed onto each of the contact lenses after step S1020. Moreover, the contact lens package array may be cut into smaller packages after step S1040, but the present disclosure is not limited thereto.

Figure 11A:
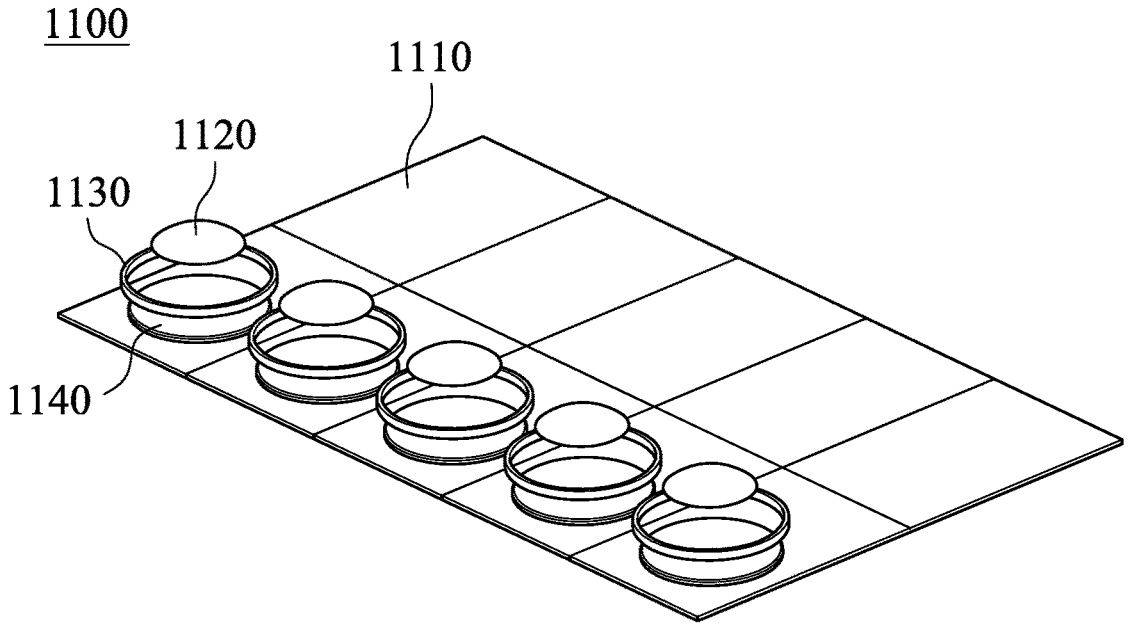
FIG. 11A is a schematic view of a contact lens package array of the 8th embodiment of the present disclosure.
Figure 11B:
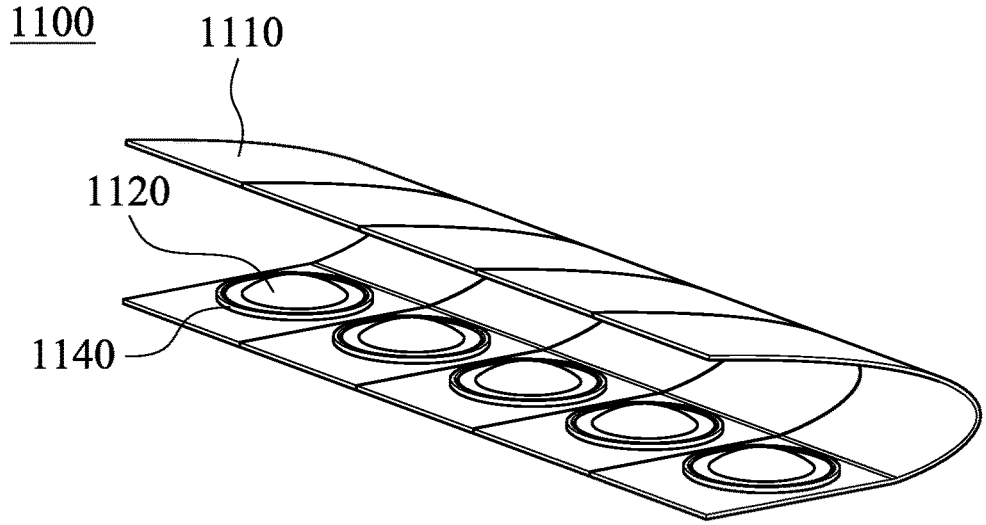
FIG. 11B is a schematic view of folding a plurality of first substrates of FIG. 11A.
Figure 11C:
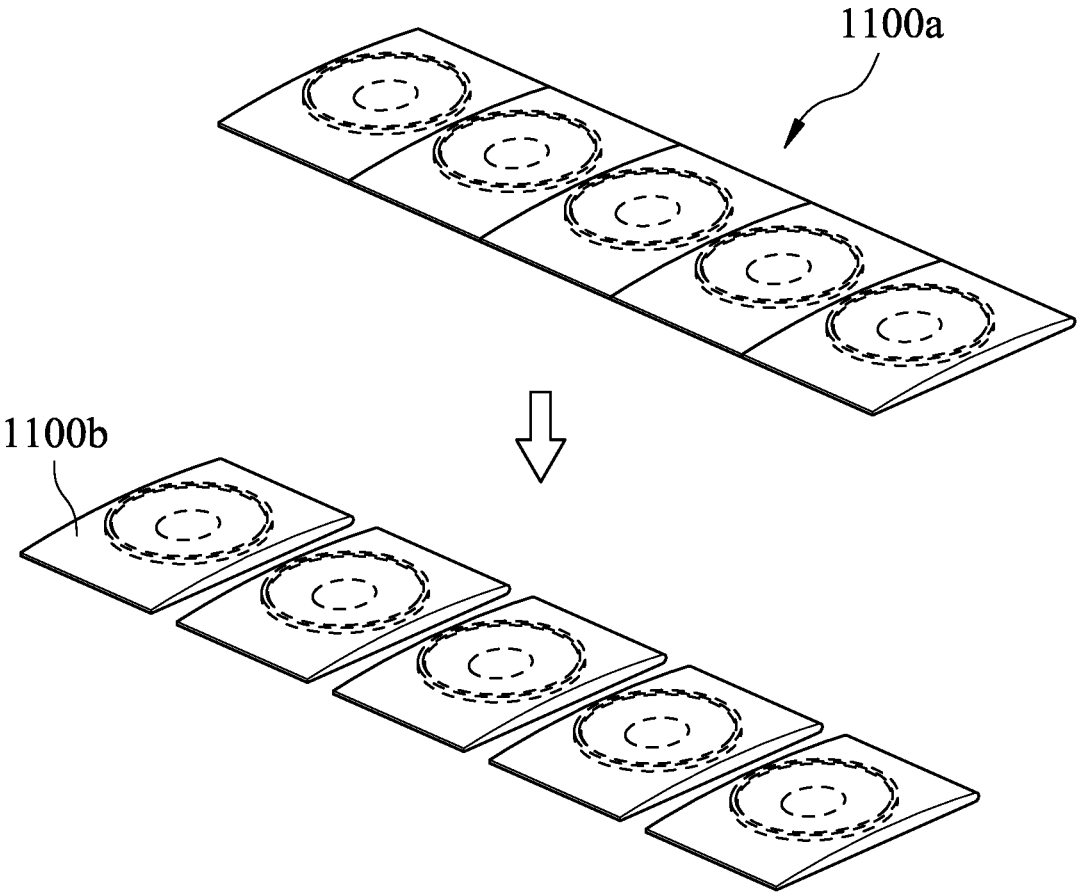
FIG. 11C is a schematic view of cutting the contact lens package array of FIG. 11B.

For clarifying the above descriptions, FIG. 11A, FIG. 11B, and FIG. 11C will be subsequently discussed, wherein FIG. 11A is a schematic view of a contact lens package array 1100 of the 8th embodiment of the present disclosure, FIG. 11B is a schematic view of folding a plurality of first substrates 1110 of FIG. 11A, and FIG. 11C is a schematic view of cutting the contact lens package array 1100 of FIG. 11B. In FIG. 11A, the contact lens package array 1100 includes the first substrates 1110, a plurality of contact lenses 1120, a plurality of guard rings 1130, and a plurality of carriers 1140. Each of the contact lenses 1120, the guard rings 1130, and the carriers 1140 may be disposed onto the first substrates 1110 based on FIG. 10 and the teachings given in the previous embodiments. Next, in FIG. 11B, the contact lens package array 1100 may be folded along the folding lines (not labeled) on the first substrates 1110, i.e., a plurality of the first substrates 1110 are folded at the same time. Afterwards, in FIG. 11C, the folded contact lens package array 1100 may be hot-press sealed to form a contact lens package array 1100*a*, and the contact lens package array 1100*a* may be cut into a plurality of smaller contact lens packages 1100*b*.

It is noted that although the carriers 1140 are illustrated in FIG. 11A, the first substrates 1110 in other embodiments may be folded, hot-press sealed, and cut with only the contact lenses 1120 and the guard rings 1130, which is not limited thereto.

9th Embodiment

Figure 12A:
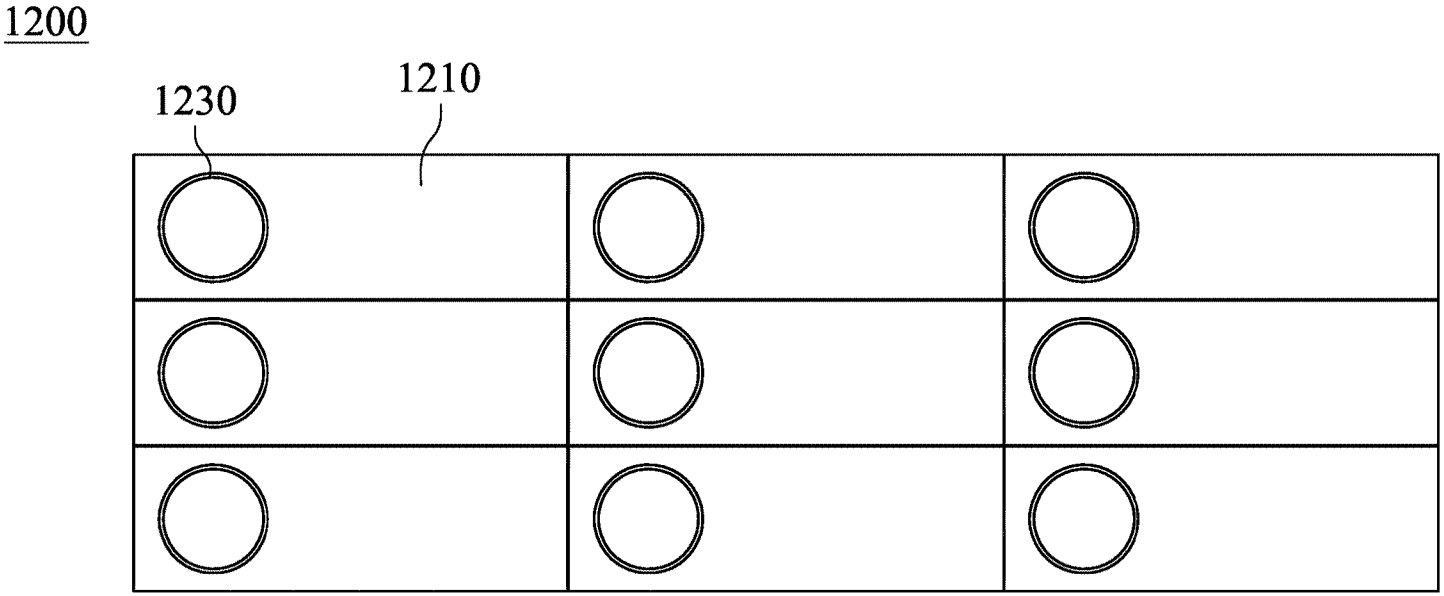
FIG. 12A is a top view of a first substrate array of the 9th embodiment of the present disclosure.
Figure 12B:
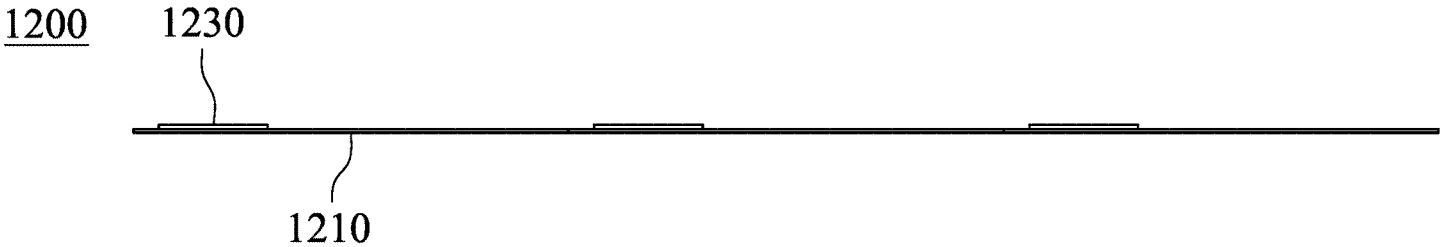
FIG. 12B is a side view of the first substrate array of FIG. 12A.
Figure 12C:
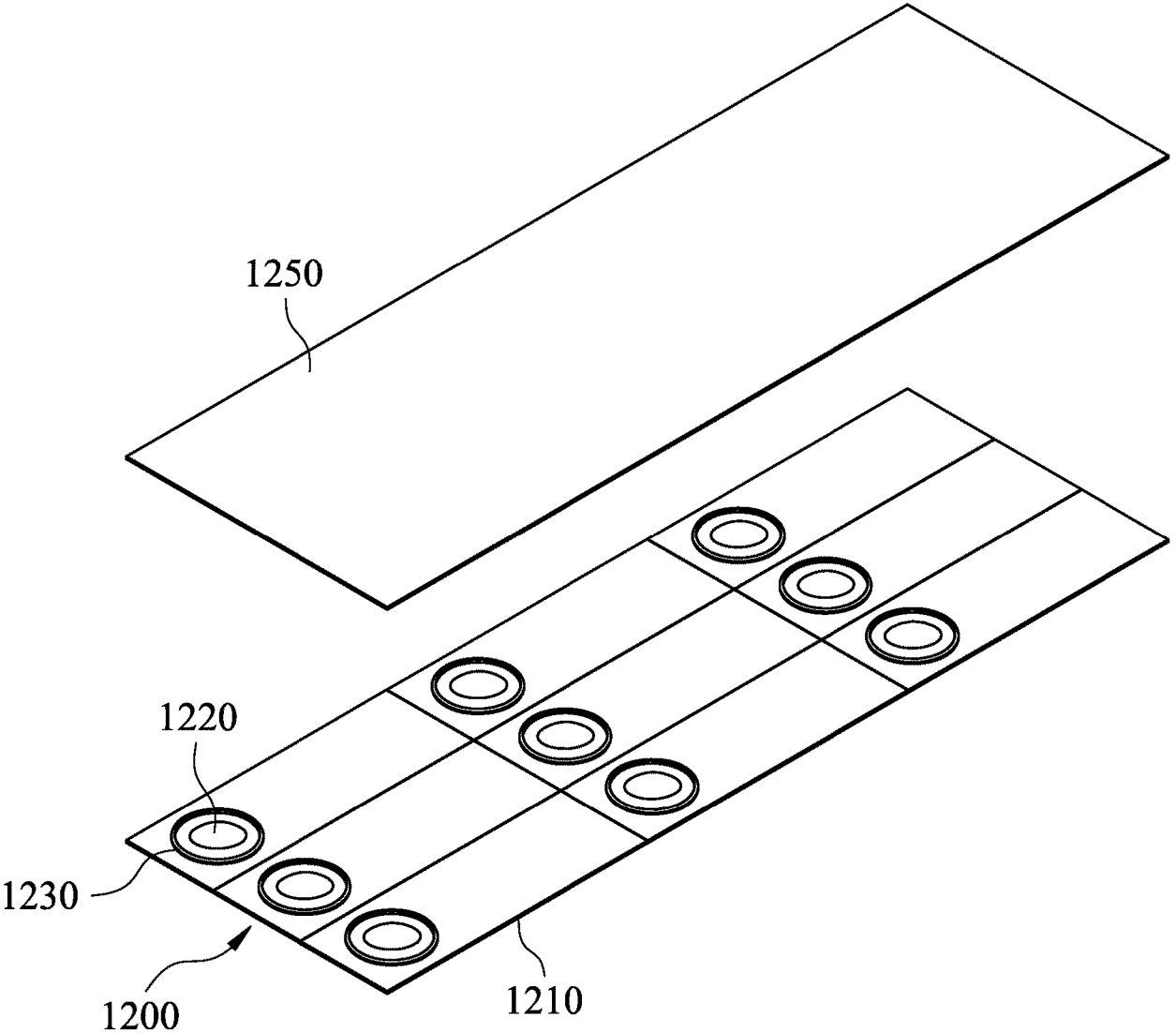
FIG. 12C is a 3-D view of the first substrate array and a second substrate of FIG. 12A.

See FIG. 12A, FIG. 12B, and FIG. 12C, wherein FIG. 12A is a top view of a first substrate array 1200 of the 9th embodiment of the present disclosure, FIG. 12B is a side view of the first substrate array 1200 of FIG. 12A, and FIG. 12C is a 3-D view of the first substrate array 1200 and a second substrate 1250 of FIG. 12A. In FIG. 12A, FIG. 12B, and FIG. 12C, a plurality of first substrates 1210 of the first substrate array 1200 may be respectively disposed with a plurality of guard rings 1230. Next, a plurality of contact lenses 1220 and carriers (not shown) may be placed onto the first substrates 1210 based on the teachings of the previous embodiments. Afterwards, the second substrate 1250 whose size corresponds to the first substrate array 1200 may be hot-press sealed onto the first substrate array 1200 to contain the guard rings 1230 and the contact lenses 1220 between the first substrate array 1200 and the second substrate 1250, and hence a contact lens package array (not shown) can be produced. Alternatively, the first substrate array 1200 may be bonded with the second substrate 1250 via ways of ultrasonic or high frequency welding, etc. Subsequently, the contact lens package array may be cut into a plurality of smaller contact lens packages, but the present disclosure is not limited thereto.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A contact lens package, comprising:

a first substrate;

a contact lens disposed on the first substrate; and a guard ring disposed on the first substrate and surrounding the contact lens, wherein the guard ring is fixed on a side surface of the first substrate;

wherein the contact lens and the guard ring are surrounded and sealed in the first substrate with the first substrate bonded by connecting two inner surfaces of the first substrate in a folded state, there is a hollow space at a center of the guard ring for containing the contact lens, and the guard ring is not deformed after sealing, wherein a height of the guard ring is Tr, and the following condition is satisfied:

$$1.5\text{ mm}<Tr<3.5\text{ mm}.$$

2. The contact lens package of claim 1, further comprising:

a carrier disposed between the contact lens and the first substrate and surrounded by the guard ring.

3. The contact lens package of claim 2, wherein the carrier has a texture structure.

4. The contact lens package of claim 3, wherein the texture structure has at least one hole.

5. The contact lens package of claim 2, wherein a thickness of the carrier is Ts, and the following condition is satisfied:

$$0.5\text{ mm}<Ts<2\text{ mm}.$$

6. The contact lens package of claim 5, wherein the thickness of the carrier is Ts, a height of the guard ring is Tr, and the following condition is satisfied:

$$1.5<Tr/Ts<7.$$

7. The contact lens package of claim 2, wherein the carrier is a circular plate with a central recess.

8. The contact lens package of claim 7, wherein a flexible structure is disposed at a center of the carrier.

9. The contact lens package of claim 7, wherein a diameter of the carrier is Ds, an inner diameter of the guard ring is Dr, and the following condition is satisfied:

$$0.6<Ds/Dr<1.6.$$

10. The contact lens package of claim 2, wherein the first substrate is disposed with a folding line.

11. The contact lens package of claim 2, wherein a peripheral region of the carrier is fixed to the first substrate.

12. The contact lens package of claim 1, further comprising:

a buffer liquid disposed on the first substrate and contacted the contact lens.

13. The contact lens package of claim 12, further comprising:

a carrier disposed between the contact lens and the first substrate and surrounded by the guard ring, wherein a volume of the buffer liquid is Vb, a thickness of the carrier is Ts, a height of the guard ring is Tr, and the following condition is satisfied:

$$0.16<Vb/(Tr-Ts)<20.$$

14. The contact lens package of claim 2, wherein the carrier has a notch.

15. The contact lens package of claim 1, wherein the first substrate is an aluminum foil.

* * * * *